US009367007B2

(12) United States Patent
Miyakoshi et al.

(10) Patent No.: US 9,367,007 B2
(45) Date of Patent: Jun. 14, 2016

(54) FIXING DEVICE AND IMAGE FORMING APPARATUS

(71) Applicant: KYOCERA Document Solutions Inc., Osaka (JP)

(72) Inventors: Naoto Miyakoshi, Osaka (JP); Masahiro Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/795,275

(22) Filed: Jul. 9, 2015

(65) Prior Publication Data

US 2016/0018770 A1 Jan. 21, 2016

(30) Foreign Application Priority Data

Jul. 16, 2014 (JP) ..... 2014-145502

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
See application file for complete search history.

(56) References Cited

U.S. PATENT DOCUMENTS 6,345,169 B1 * 2/2002 Haneda ..... G03G 15/2064 219/216
6,442,360 B1 * 8/2002 Onodera ..... G03G 15/2053 219/216
2008/0080910 A1 * 4/2008 Senda ..... G03G 15/206 399/328

FOREIGN PATENT DOCUMENTS

JP 2005-292644 A 10/2005

* cited by examiner

*Primary Examiner* — Sandra Brase
(74) *Attorney, Agent, or Firm* — Studebaker & Brackett PC

(57) ABSTRACT

A fixing device includes a rotating member, a bearing and a holding member. The rotating member is configured to fix a toner image on a recording medium. The bearing is configured to support the rotating member so that the rotating member is rotatable around a rotation axis. The holding member is configured to hold the bearing. The holding member has a restricting part configured to face an outside face in the rotation axis direction of the bearing at an interval.

10 Claims, 9 Drawing Sheets

FIXING DEVICE AND IMAGE FORMING APPARATUS

INCORPORATION BY REFERENCE

This application is based on and claims the benefit of priority from Japanese patent application No. 2014-145502 filed on Jul. 16, 2014, the entire contents of which are incorporated herein by reference.

BACKGROUND

The present disclosure relates to a fixing device fixing a toner image on a recording medium and an image forming apparatus including the fixing device.

Conventionally, an electrographic image forming apparatus, such as a copying machine or a printer, includes a fixing device fixing a toner image on a recording medium.

For example, there is a fixing device including a rotating member configured to fix a toner image on a recording medium, a bearing configured to support the rotating member so that the rotating member is rotatable and a holding member configured to hold the bearing.

With regard to the fixing device with such a configuration, a C ring comes into contact with an outside face of the bearing so that a dropping of the bearing from the holding member is prevented. Accordingly, if the rotating member presses the bearing to an outside in accordance with thermal expansion of the rotating member, there is a fear that the bearing may be broken because of an excessive force applied to the bearing and a malfunction of the fixing device or occurrence of an abnormal sound may be caused. Additionally, with regard to the fixing device with such a configuration, there is a fear that the configuration of the fixing device may be complicated in accordance with the installation of the C ring.

SUMMARY

In accordance with an embodiment of the present disclosure, a fixing device includes a rotating member, a bearing and a holding member. The rotating member is configured to fix a toner image on a recording medium. The bearing is configured to support the rotating member so that the rotating member is rotatable around a rotation axis. The holding member is configured to hold the bearing. The holding member has a restricting part configured to face an outside face in the rotation axis direction of the bearing at an interval.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Firstly, the entire structure of a printer 1 (an image forming apparatus) will be described.

Figure 1:
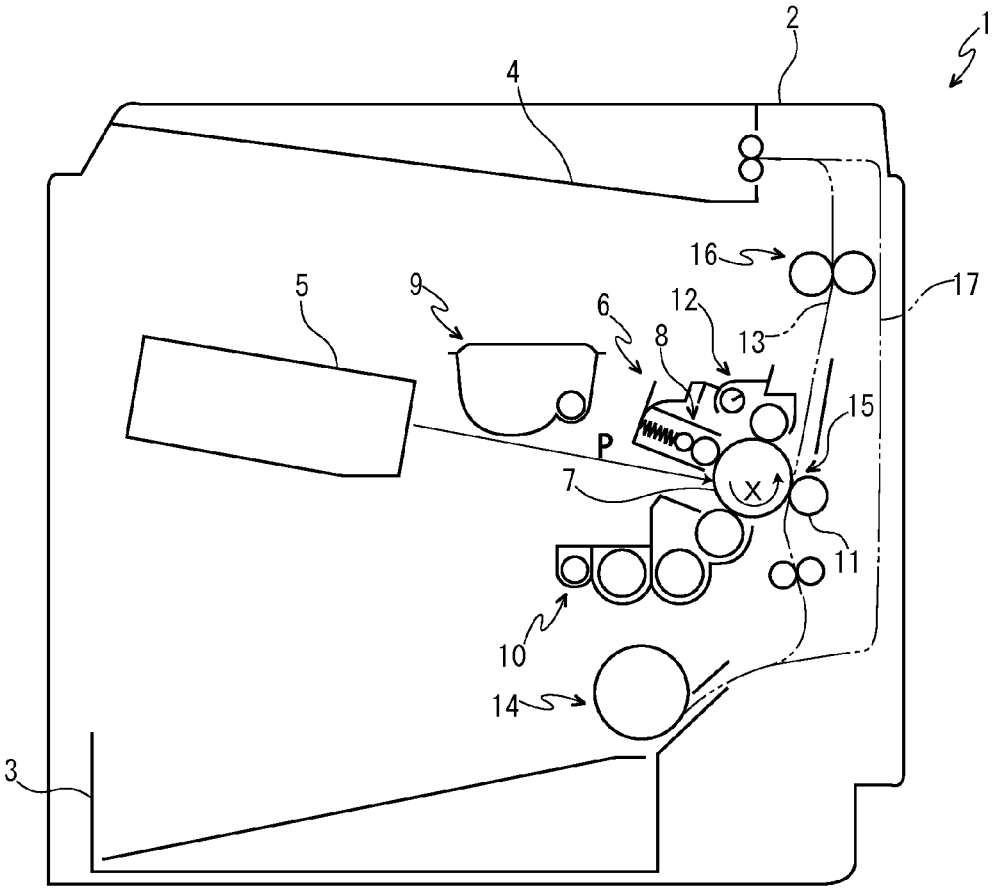
FIG. 1 is a schematic view schematically showing a printer according to an embodiment of the present disclosure.

As shown in FIG. 1, The printer 1 includes a box-like printer main body 2. In a lower part of the printer main body 2, a sheet feeding cassette 3 storing sheets (recording medium) is provided and, in an upper end of the printer main body 2, a sheet ejecting tray 4 is provided.

In a left upper part of the printer main body 2, an exposure device 5 composed of a laser scanning unit (LSU) is arranged. In a right side part of the printer main body 2, an image forming unit 6 are provided. In the image forming unit 6, a photosensitive drum 7 (image carrier) is rotatably provided. Around the photosensitive drum 7, a charger 8, a developing device 10 connected to a toner container 9, a transferring roller 11 and a cleaning device 12 are arranged along the rotational direction of the photosensitive drum 7 (refer to an arrow X in FIG. 1).

In the right side part of the printer main body 2, a sheet conveying path 13 is provided from a lower side to an upper side. At an upper stream end of the conveying path 13, a sheet feeder 14 is provided. At an intermediate stream part of the conveying path 13, a transferring part 15 formed by the photosensitive drum 7 and the transferring roller 11 is provided. At a lower stream part of the conveying path 13, a fixing device 16 is provided. At the right side of the conveying path 13, an inversion path 17 for both sides printing is provided.

Next, the operation of forming an image by the printer 1 having such a configuration will be described.

When image data is inputted and a printing start is directed from a computer or the like connected with the printer 1, the image forming operation is carried out as follows.

First, the surface of the photosensitive drum 7 is electrically charged by the charger 8. Then, the photosensitive drum 7 is exposed corresponding to the image data with a laser (refer to an arrow P of FIG. 1) from the exposure device 5, thereby forming an electrostatic latent image on a surface of the photosensitive drum 7. Next, the electrostatic latent image is developed to a toner image by the development device 10 with the toner supplied from the toner container 9.

On the other hand, a sheet fed from the sheet feeding cassette 3 by the sheet feeder 14 is conveyed to the transferring part 15 in a suitable timing for the above-mentioned image forming operation. Then, at the transferring part 15, the toner image on the photosensitive drum 7 is transferred to the sheet. The sheet with the transferred toner image is conveyed to a lower stream side on the conveying path 13 to enter the fixing device 16, and then, the toner image is fixed on the sheet at the fixing device 16. The sheet with the fixed toner image is ejected from the downstream end of the conveying path 13 to the sheet ejecting tray 4. The toner remained on the photosensitive drum 7 is collected by the cleaning device 12.

Next, the fixing device 16 will be described in detail.

Hereinafter, a near side of FIG. 2 will be described as a front side of the fixing device 16, for convenience of explanation. Arrows Fr, Rr, L, R, U and Lo of each figure indicate a front side, a rear side, a left side, a right side, an upper side and a lower side of the fixing device 16, respectively. An arrow Y of FIG. 2 indicates a conveying direction of the sheet (in the embodiment, an upper and lower direction). An arrow I of each figure indicates an inside in a front and rear direction and an arrow O of each figure indicates an outside in the front and rear direction.

Figure 2:
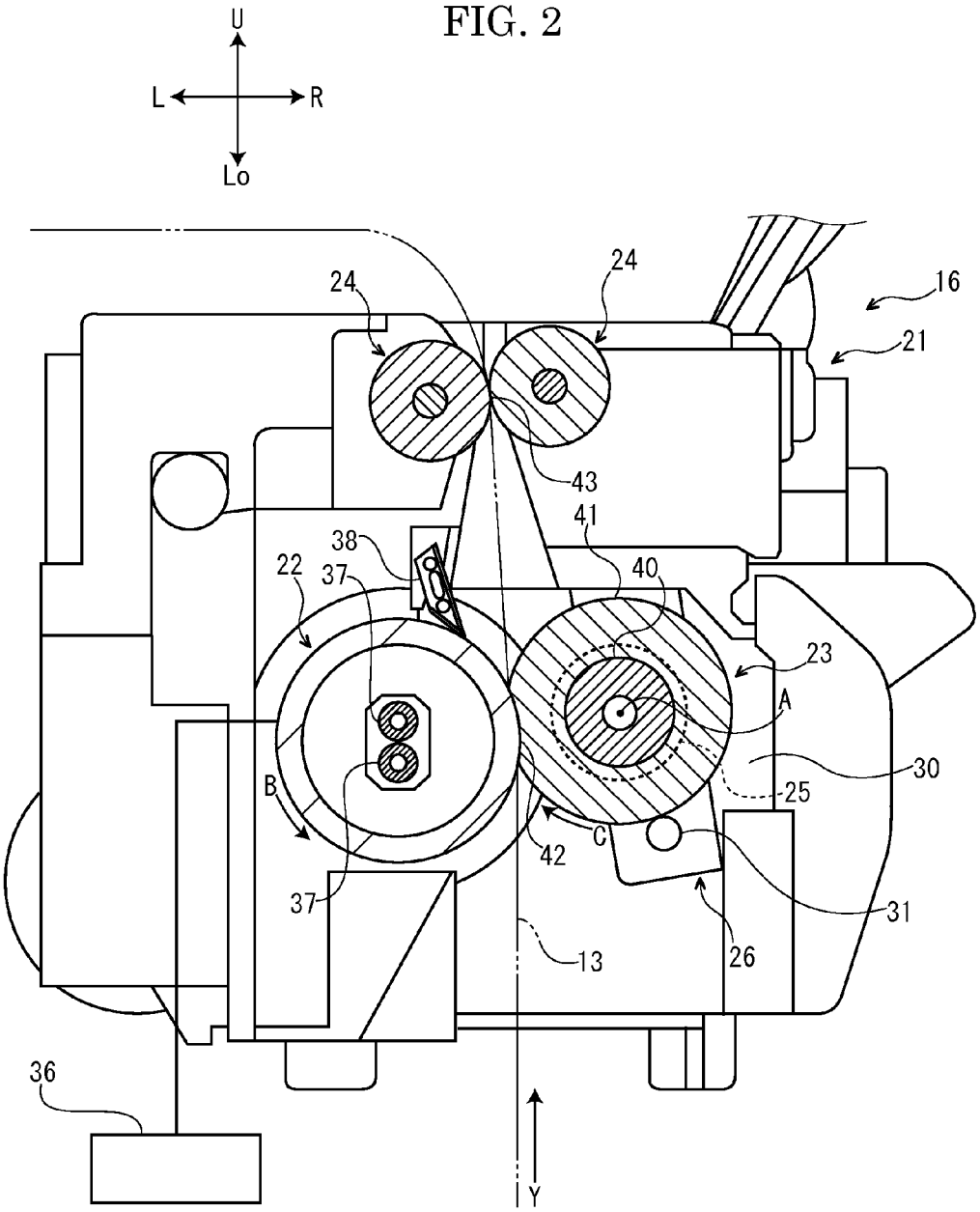
FIG. 2 is a sectional view showing a fixing device according to the embodiment of the present disclosure.

As shown in FIG. 2, the fixing device 16 includes a fixing frame 21 (supporting member) which is formed in a box-like shape, a heated roller 22 (heated member) which is housed in a left side part of the fixing frame 21, a pressuring roller 23 (rotating member) which is housed in a right side part of the fixing frame 21, a pair of ejecting rollers 24 which are provided at an upper end part of the fixing frame 21, and bearings 25 and holding members 26 which are respectively provided at a front side and a rear side of the pressuring roller 23 (only the bearing 25 on the rear side and the holding member 26 on the rear side are shown in FIG. 2).

Figure 3:
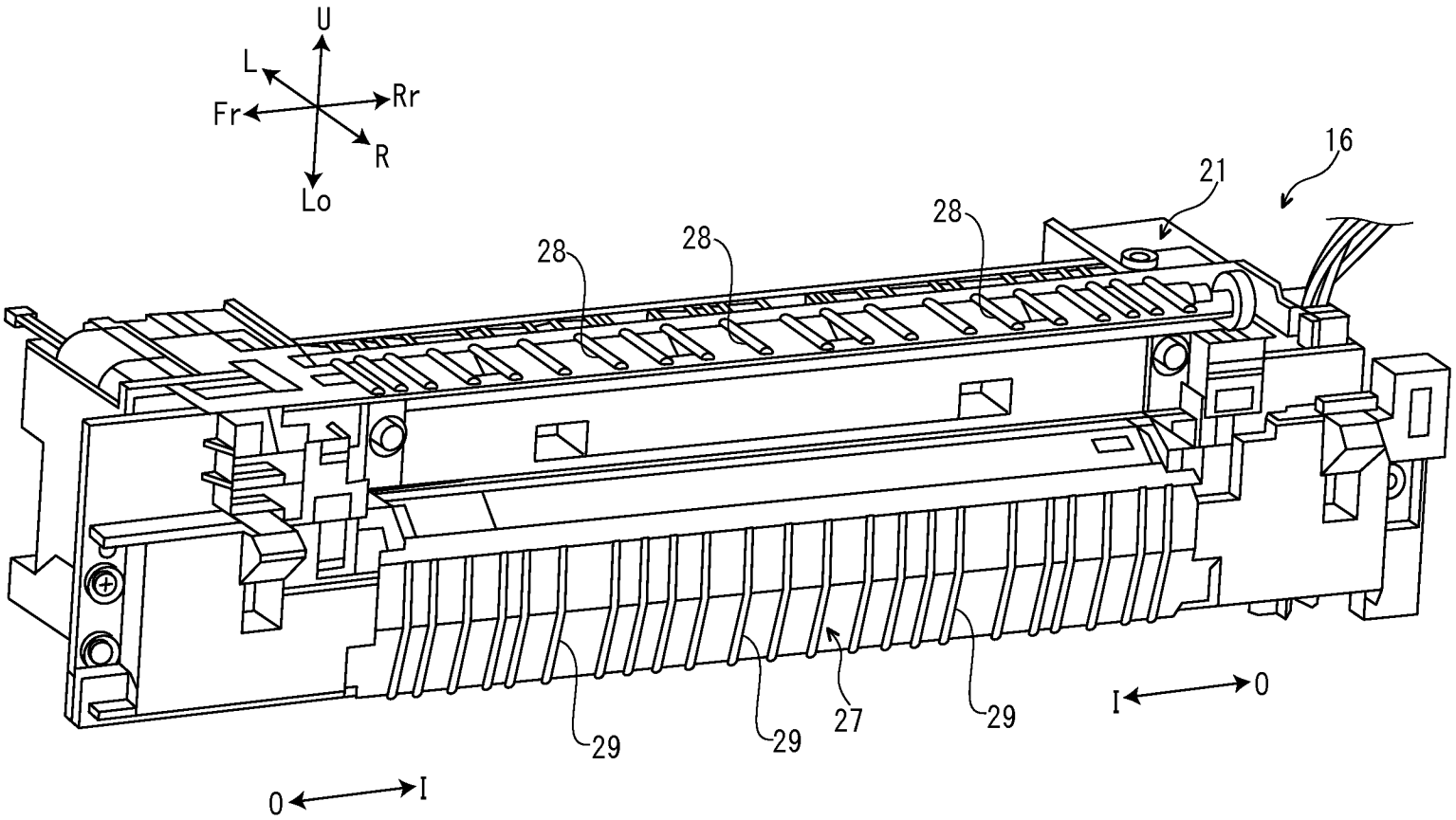
FIG. 3 is a perspective view showing a fixing device according to the embodiment of the present disclosure.

As shown in FIG. 3, the fixing frame 21 is formed in a shape elongated in the front and rear direction. The fixing frame 21 includes an outer frame 27. On an upper face of the outer frame 27, multiple upper side convey ribs 28 are provided, and, on a right face of the outer frame 27, multiple right side convey ribs 29 are provided.

Figure 4:
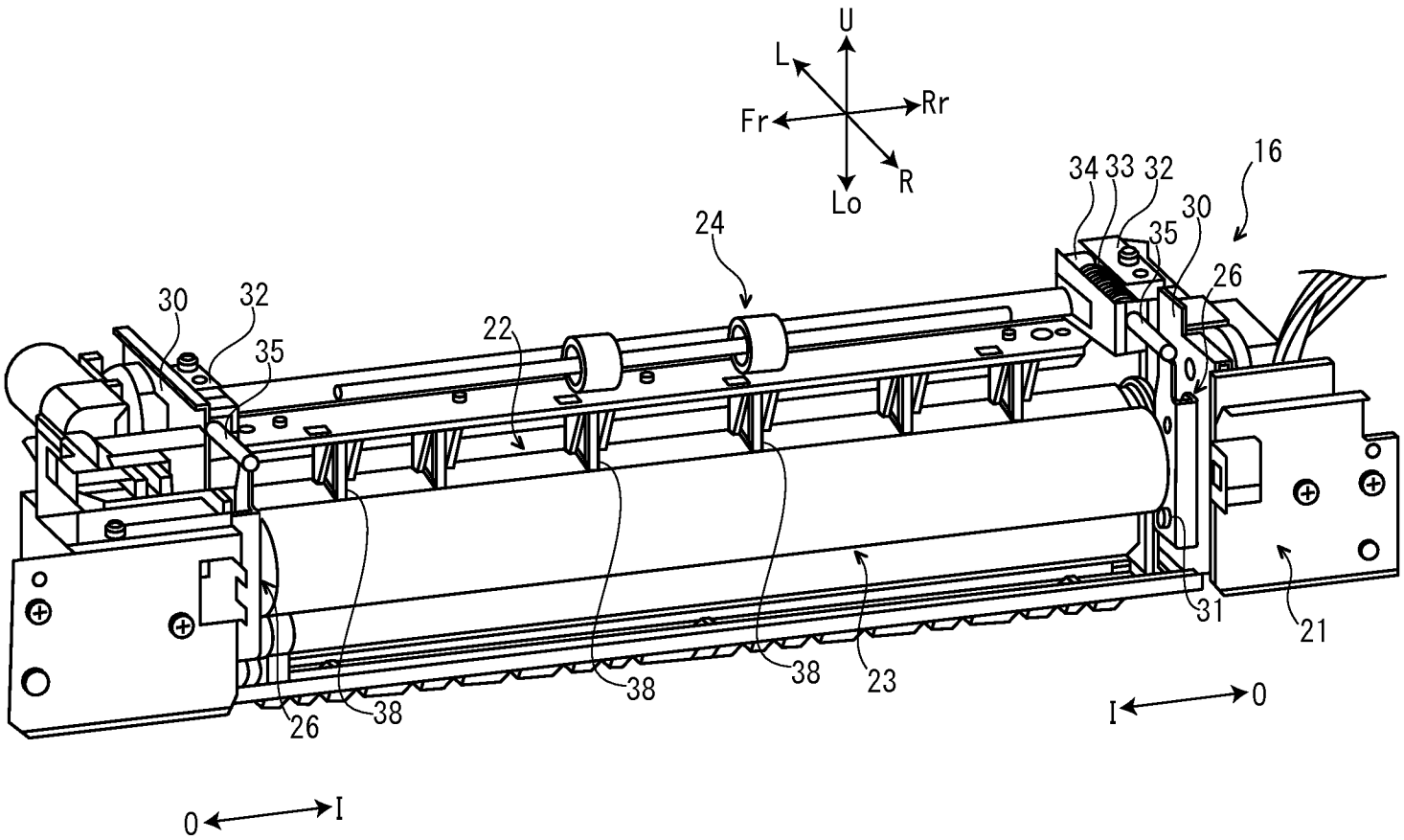
FIG. 4 is a perspective view showing a state that an outer frame of a fixing frame is removed in the fixing device according to the embodiment of the present disclosure.

As shown in FIG. 4, support plates 30 are provided upright on a front end side and a rear end side of the fixing frame 21, respectively. At lower end parts of the support plates 30, support shafts 31 are fixed. At upper end sides of the support plates 30, spring housing parts 32 are provided, and, in the spring housing parts 32, coil springs 33 (biasing members) are housed. At a left side of the coil springs 33, cams 34 are provided. At a right side of the coil springs 33, engagement shafts 35 (engagement members) including hook parts (not shown) are provided.

The heated roller 22 (see FIG. 2 or other figures) is formed in a shape elongated in the front and rear direction. The heated roller 22 includes, for example, a cylindrical base material layer made of metal, such as aluminum or iron, an elastic layer, which is made of a silicon rubber or the like, and provided around the base material layer and a release layer, which is made of fluororesin, such as a PFA, and covers the elastic layer. In FIG. 2, each layer (the base material layer, the elastic layer or the release layer) of the heated roller 22 is not distinguished with each other.

The heated roller 22 is rotatably supported by the fixing frame 21. The heated roller 22 is connected to a drive source 36 formed by a motor or the like, and the heated roller 22 is rotated by the drive source 36.

In an internal space of the heated roller 22, a pair of upper and lower heaters 37 (heat sources) are housed. Each heater 37 is formed by a halogen heater or a ceramic heater, for example.

At an upper side of the heated roller 22 (a downstream side in the sheet conveying direction), separation claws 38 are provided. As shown in FIG. 4, a plurality of (e.g. six) separation claws 38 are provided at intervals in the front and rear direction. The lower end parts (distal end parts) of the separation claws 38 come into contact with an outer circumferential face of the heated roller 22.

The pressuring roller 23 (see FIG. 2 and other figures) is formed in a shape elongated in the front and rear direction. The pressuring roller 23 includes, for example, a cylindrical core material 40 made of metal, such as aluminum or iron, an elastic layer 41, which is made of a silicon rubber or the like, and provided around the core material 40 and a release layer (not shown), which is made of fluororesin, such as a PFA, and covers the elastic layer 41.

The pressuring roller 23 comes into pressure contact with the heated roller 22 so as to form a fixing nip 42 between the heated roller 22 and the pressuring roller 23.

A pair of ejecting rollers 24 (see FIG. 2 and other figures) are formed in a shape elongated in the front and rear direction. A pair of ejecting rollers 24 come into pressure contact with each other so as to form an ejecting nip 43 between a pair of the ejecting rollers 24.

The bearings 25 (see FIG. 5 and other figures) are formed by ball bearings, for example. The bearings 25 are attached to a front end part and a rear end part of the core material 40 of the pressuring roller 23, and rotatably hold the pressuring roller 23. According to this, the pressuring roller 23 is rotatable around a rotation axis A extending in the front and rear direction. That is, in the present embodiment, the front and rear direction is a rotation axis direction of the pressuring roller 23.

Figure 5:
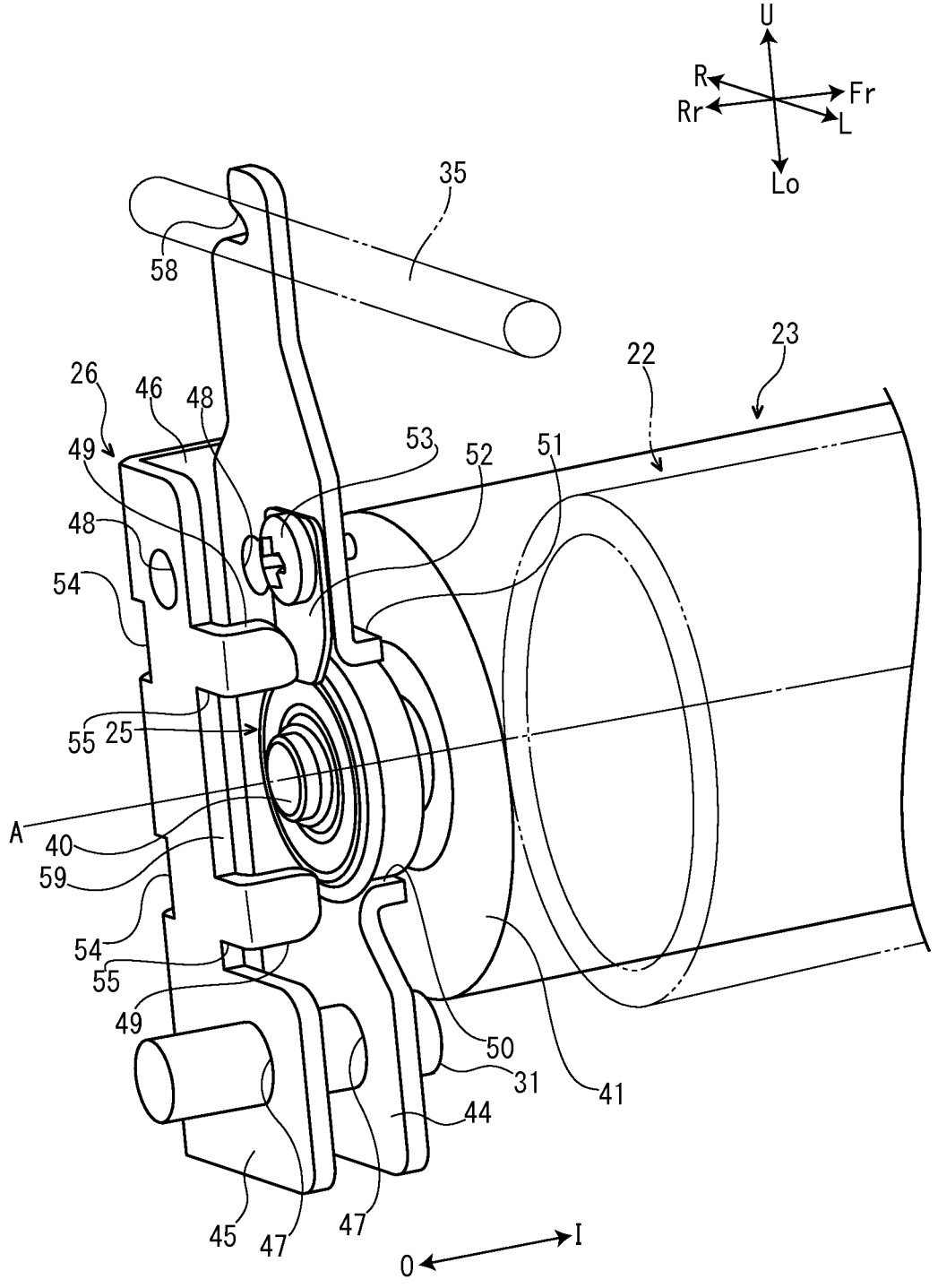
FIG. 5 is a perspective view showing a holding member and its periphery in the fixing device according to the embodiment of the present disclosure.

As shown in FIG. 5 and other figures, each holding member 26 is formed by bending a sheet metal, for example. The holding member 26 includes an inside part 44, an outside part 45 which is arranged at an outside of the inside part 44 in the front and rear direction, a connecting part 46 which connects a right end part (one end part in a width direction) of the inside part 44 and a right end part (one end part in a width direction) of the outside part 45, and a pair of upper and lower restricting parts 49 which are provided at a left end part (other end part in the width direction) of the outside part 45.

At lower parts of the inside part 44 and the outside part 45 of each holding member 26, insertion holes 47 are provided. The support shaft 31 fixed to the lower end part of the support plate 30 of the fixing frame 21 is inserted through the insertion holes 47, and, according to this, each holding member 26 is swingably supported by the fixing frame 21. At upper parts of the inside part 44 and the outside part 45, communication holes 48 are provided.

At an upper end part of the inside part 44 of each holding member 26, a hook part 58 is provided. The hook part 58 engages with the hook part (not shown) of the engagement shaft 35.

At a nearly center part in the upper and lower direction of the inside part 44 of each holding member 26, a fitting groove 50 (fitting part) which is curved in an arc shape is provided, and each bearing 25 fits to the fitting groove 50. According to this configuration, each bearing 25 is held by the inside part 44 of each holding member 26. The fitting groove 50 is depressed from a left edge part of the inside part 44 to the right side. In the inside part 44, a flange part 51 which protrudes from an outer circumference of the fitting groove 50 to an inside in the front and rear direction is provided.

To the inside part 44 of each holding member 26, a leaf spring 52 (biasing member) is attached at an upper side of the fitting groove 50. An upper part of the leaf spring 52 is fixed to an outside face in the front and rear direction of the inside part 44 via a screw 53. A lower part of the leaf spring 52 comes into contact with an outer circumferential end part of the outside face in the front and rear direction of each bearing 25. According to this configuration, the leaf spring 52 biases each bearing 25 toward the inside in the front and rear direction. The lower part of the leaf spring 52 is arranged between the outer circumferential end part of the outside face in the front and rear direction of each bearing 25 and the upper restricting part 49.

In each holding member 26, a pair of upper and lower notch parts 54 are provided across the outside part 45 and the connecting part 46. At an upper left part of the outside part 45 of each holding member 26, a concave part 59 of a nearly rectangular shape is provided. At lateral edge parts of the concave part 59, a pair of upper and lower protruding pieces 55 which protrude toward leftward are provided at heights corresponding to the notch parts 54.

Figure 6:
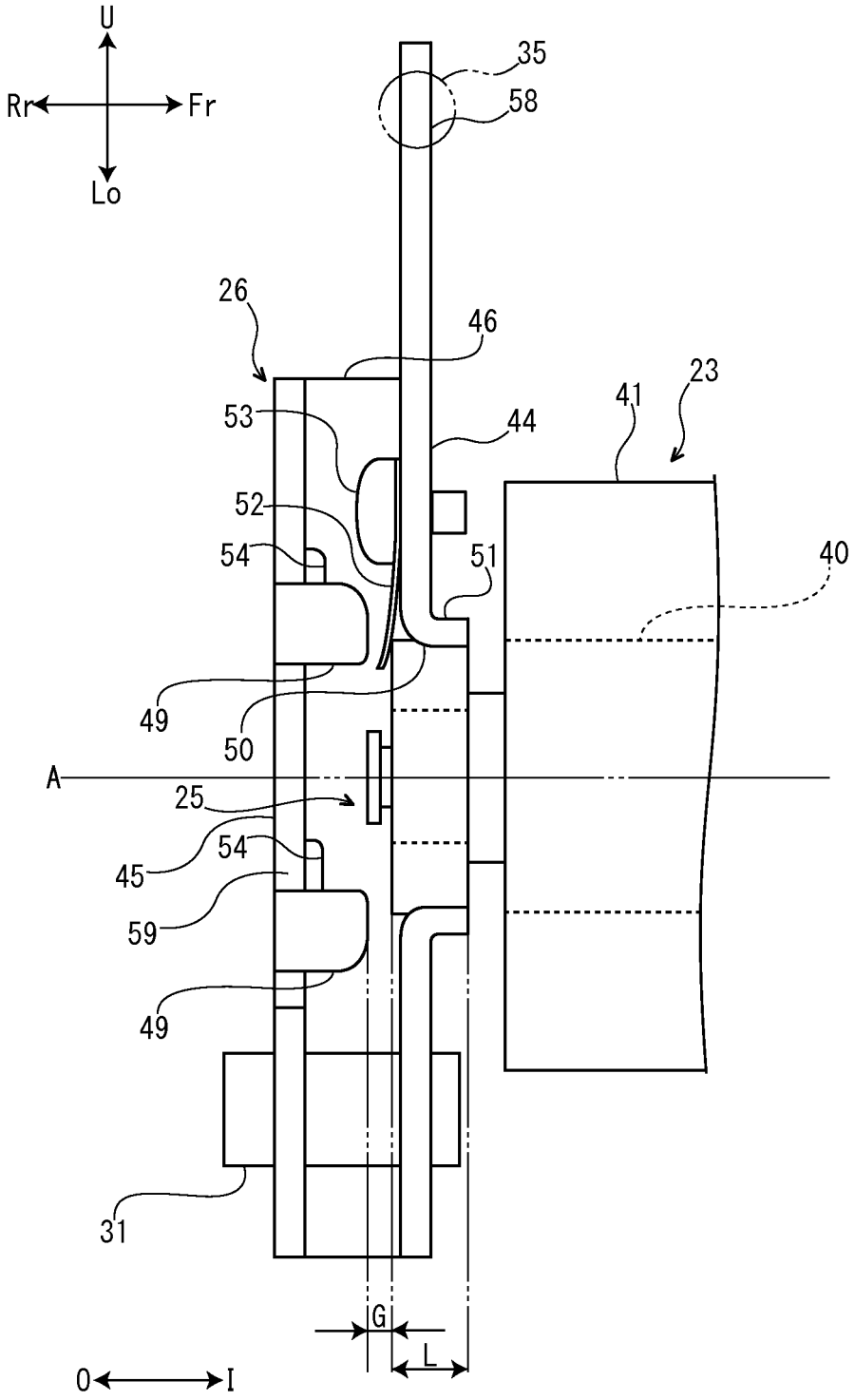
FIG. 6 is a side view showing the holding member and its periphery in a state before a pressuring roller is thermally expanded in the fixing device according to the embodiment of the present disclosure.

The restricting parts 49 of each holding member 26 protrude from left end parts (distal end parts) of the protruding pieces 55 of the outside part 45 to the inside in the front and rear direction. A plurality of (two in the present embodiment) restricting parts 49 are provided at equal angle intervals (180 degrees in the present embodiment) around the rotation axis A of the pressuring roller 23. As shown in FIG. 6 and other figures, a front end part (an end part at the inside in the front and rear direction) of each restricting part 49 faces the outside face in the front and rear direction of the inside part 44 at an interval at a surrounding of the fitting groove 50, and faces an outer circumferential end part of the outside face in the front and rear direction of each bearing 25 at an interval G. The interval G is shorter than a length L of each bearing 25 in the front and rear direction.

With regard to the fixing device 16 applying the above-described configuration, when a toner image is fixed to a sheet, the drive source 36 rotates the heated roller 22 (see arrow B in FIG. 2). When the heated roller 22 is rotated in this way, the pressuring roller 23 which comes into pressure contact with the heated roller 22 is driven by the heated roller 22 to rotate (see arrow C in FIG. 2). Further, the heater 37 is energized and the heater 37 heats the heated roller 22 to fix the toner image to the sheet. When the sheet passes through the fixing nip 42 in this state, the sheet and the toner image are heated and pressed, so that the toner image is fixed to the sheet. The sheet to which the toner image has been fixed is separated from the heated roller 22 by the separation claws 38, and is ejected to an outside of the fixing device 16 by a pair of ejecting rollers 24.

When the heater 37 heats the heated roller 22 as described above, the pressuring roller 23 which comes into pressure contact with the heated roller 22 is also heated, and the pressuring roller 23 thermally expands. When the pressuring roller 23 thermally expands in this way, there is a fear that the bearings 25 attached respectively to the front end part and the rear end part of the core material 40 of the pressuring roller 23 are pushed toward the outside in the front and rear direction by the core material 40 of the pressuring roller 23, and drop from the holding members 26.

However, in the present embodiment, the restricting parts 49 of the holding members 26 face the outside face in the front and rear direction of the bearings 25, so that it is possible to restrict movement of the bearings 25 toward the outside in the front and rear direction and prevent the bearings 25 from dropping from the holding members 26. In the present embodiment in particular, the interval G between the outside face in the front and rear direction of each bearing 25 and each restricting part 49 is shorter than the length L of each bearing 25 in the front and rear direction, so that it is possible to reliably prevent the bearings 25 from dropping from the holding members 26. Further, a plurality of (two in the present embodiment) restricting parts 49 are provided at equal angle intervals (180 degree intervals in the present embodiment) around the rotation axis A of the pressuring roller 23, so that it is possible to more effectively prevent the bearings 25 from dropping from the holding members 26.

Furthermore, the restricting parts 49 of the holding members 26 prevent the bearings 25 from dropping from the holding members 26, so that it is not necessary to add a new member to prevent the bearings 25 from dropping from the holding members 26. Hence, it is possible to simplify the configuration of the fixing device 16.

Figure 7:
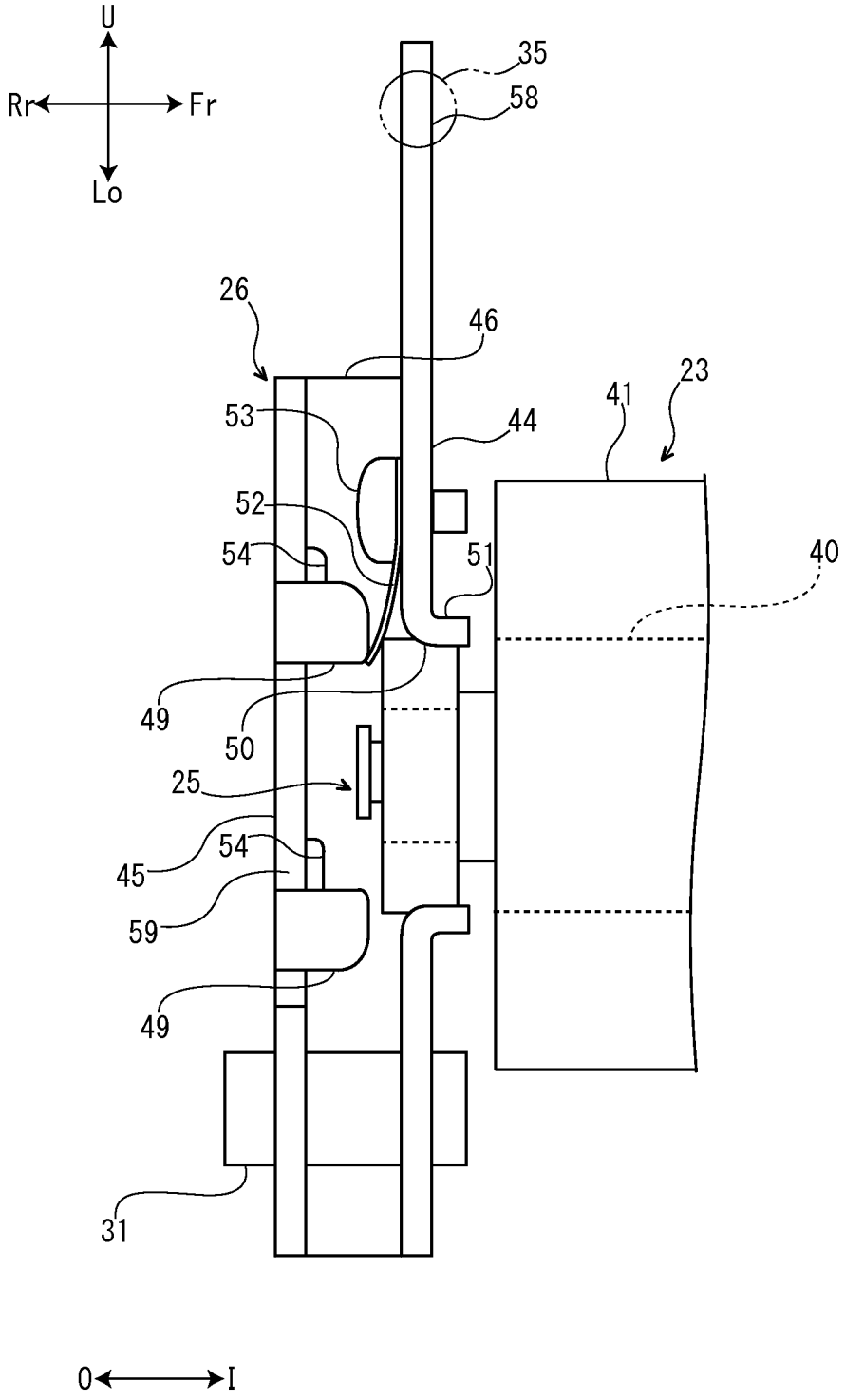
FIG. 7 is a side view showing the holding member and its periphery in a state after the pressuring roller is thermally expanded in the fixing device according to the embodiment of the present disclosure.

Further, the interval G is provided between the outside face in the front and rear direction of each bearing 25 and each restricting part 49, so that, when the core material 40 of the pressuring roller 23 pushes the bearings 25 toward the outside in the front and rear direction in accordance with thermal expansion of the pressuring roller 23, it is possible to move the bearings 25 toward the outside in the front and rear direction in the interval G (see FIG. 7). Consequently, it is possible to prevent an excessive force from being applied to the bearings 25 and damaging the bearings 25, and prevent a malfunction of the fixing device 16 and occurrence of an abnormal sound.

Further, each holding member 26 includes the inside part 44 which holds each bearing 25, the outside part 45 which is arranged at the outside in the front and rear direction of the inside part 44, and the connecting part 46 which connects the inside part 44 and the outside part 45, and the restricting parts 49 protrude toward the inside in the front and rear direction from the outside part 45. By applying this configuration, it is possible to easily form the restricting parts 49.

Furthermore, the leaf spring 52 is attached to each holding member 26, and this leaf spring 52 biases each bearing 25 toward the inside in the front and rear direction. By applying this configuration, it is possible to prevent the position of the pressuring roller 23 in the front and rear direction from varying. Consequently, the pressuring roller 23 can reliably fix a toner image to a sheet. Further, the leaf springs 52 are arranged between the outside faces in the front and rear direction of the bearings 25 and the upper restricting parts 49, so that it is possible to prevent the outside in the front and rear direction faces of the bearings 25 from contacting the restricting parts 49.

Furthermore, the fixing device 16 includes the heater 37 and the heated roller 22 which is heated by the heater 37, and the pressuring roller 23 comes into pressure contact with the heated roller 22 so as to form the fixing nip 42. By applying this configuration, it is possible to simplify the configuration of the fixing device 16.

Figure 8A:
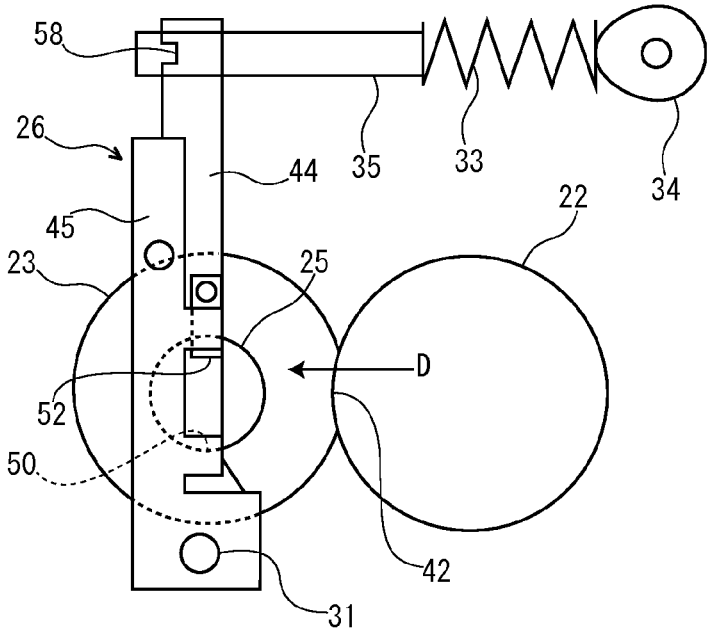
FIG. 8A is a schematic view showing a state that the holding member is in a first posture in the fixing device according to the embodiment of the present disclosure.

Further, with regard to the fixing device 16 applying the above-described configuration, to fix a toner image to a sheet, as shown in FIG. 8A, the hook parts 58 of the holding members 26 engage with the hook parts (not shown) of the engagement shafts 35. According to this, the pressuring roller 23 comes into pressure contact with the heated roller 22 so as to form the fixing nip 42. A posture of the holding members 26 in this case is a first posture.

In a state where the holding members 26 are in the first posture as described above, a pressing force D which works from the heated roller 22 to the pressuring roller 23 presses the bearings 25 toward the fitting grooves 50 of the holding members 26, and removal of the bearings 25 from the fitting grooves 50 is restricted. Therefore, it is not possible to separate the pressuring roller 23 and the bearings 25 from the holding members 26.

In addition, when the cams 34 are rotated in a state where the holding members 26 are in the first posture as described above, the cams 34 press the engagement shafts 35 via the coil springs 33, then the holding members 26 swing around the support shafts 31 and the pressure of the fixing nip 42 is switched.

Figure 8B:
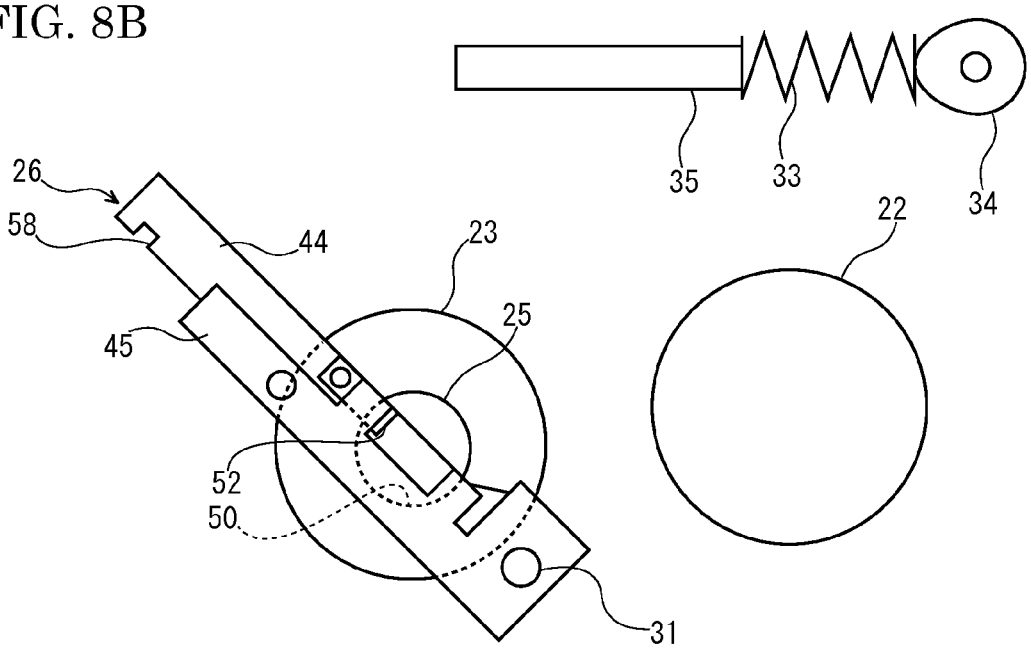
FIG. 8B is a schematic view showing a state that the holding member is in a second posture in the fixing device according to the embodiment of the present disclosure.

Meanwhile, when the pressuring roller 23 is exchanged, as shown in FIG. 8B, engagement of the hook parts 58 of the holding members 26 with the hook parts (not shown) of the engagement shafts 35 is released. According to this, the holding members 26 swing around the support shafts 31, and the pressuring roller 23 separates from the heated roller 22. A posture of the holding members 26 in this case is a second posture.

In a state where the holding members 26 are in the second posture as described above, it is possible to remove the bearings 25 from the fitting grooves 50 of the holding members 26, and separate the pressuring roller 23 and the bearings 25 from the holding members 26.

In the present embodiment, in a state where the holding members 26 are in the first posture, removal of the bearings 25 from the fitting grooves 50 of the holding members 26 is restricted, and, in a state where the holding members 26 are in the second posture, the bearings can be removed from the fitting grooves 50 of the holding members 26. By applying this configuration, it is possible to simply exchange the pressuring roller 23, and improve maintainability of the fixing device 16.

Figure 9:
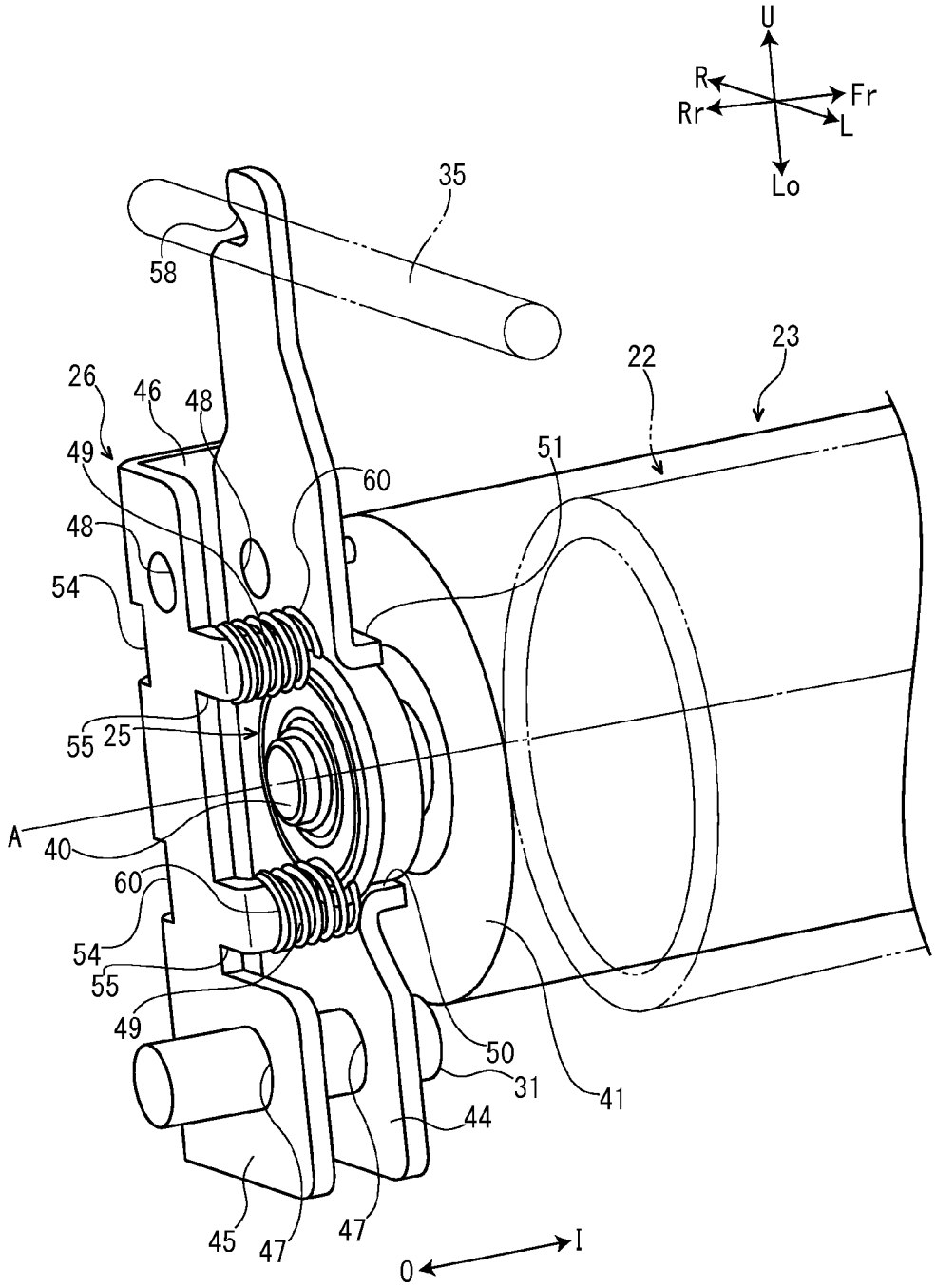
FIG. 9 is a perspective view showing a holding member and its periphery in a fixing device according to another embodiment of the present disclosure.

In the embodiment, the leaf spring 52 is used as a biasing member. In another embodiment, as shown in FIG. 9, a coil spring 60 may be used as a biasing member. In such a case, the coil spring 60 may be attached to an outer circumference of the restricting part 49 of the holding member 26 so that the coil spring 60 is attached to the holding member 26 without adding a new member.

In the embodiment, only one biasing member is arranged. In another embodiment, as shown in FIG. 9, a plurality of biasing members may be arranged. In such a case, a plurality of the biasing members may be arranged around the rotation axis A of the pressuring member 23 at an equal angle interval so that the biasing members can stably bias the bearings 25.

In the embodiment, the heated roller 22 is used as a heated member. In another embodiment, a heated belt may be used as a heated member.

In the embodiment, the pressuring roller 23 is used as a rotating member. In another embodiment, the heated roller 22 or the heated belt may be used as a rotating member.

In the embodiment, two restricting parts 49 are arranged at the holding member 26. In another embodiment, only one restricting part 49 or more than two restricting parts 49 may be arranged at the holding member 26.

In the embodiment, the heater 37 is used as a heat source. In another embodiment, an IH coil or the like may be used as a heat source.

In the embodiment, the configuration of the present disclosure is applied to the printer 1. In another embodiment, the configuration of the present disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a rotating member configured to fix a toner image on a recording medium;

a bearing configured to support the rotating member so that the rotating member is rotatable around a rotation axis; and a holding member configured to hold the bearing, wherein the holding member has:

a restricting part configured to face an outside face in the rotation axis direction of the bearing at an interval;

an inside part configured to hold the bearing;

an outside part arranged outside of the inside part in the rotation axis direction; and a connecting part configured to connect the inside part and the outside part, and wherein the restricting part is configured to protrude from the outside part toward an inside in the rotation axis direction.

2. The fixing device according to claim 1, wherein there are a plurality of the restricting parts, the restricting parts being arranged around the rotation axis at an equal angle interval.

3. The fixing device according to claim 1, further comprising a biasing member attached to the holding member and configured to bias the bearing toward an inside in the rotation axis direction.

4. The fixing device according to claim 3, wherein the biasing member is a leaf spring arranged between the outside face in the rotation axis direction of the bearing and the restricting part.

5. The fixing device according to claim 3, wherein the biasing member is a coil spring attached to an outer circumference of the restricting part.

6. The fixing device according to claim 1, wherein distance between the outside face in the rotation axis direction of the bearing and the restricting part is shorter than length of the bearing in the rotation axis direction.

7. The fixing device according to claim 1, wherein the holding member is formed by bending a sheet metal.

8. An image forming apparatus comprising the fixing device according to claim 1.

9. A fixing device comprising:

a rotating member configured to fix a toner image on a recording medium;

a bearing configured to support the rotating member so that the rotating member is rotatable around a rotation axis; and a holding member configured to hold the bearing, wherein the holding member has a restricting part configured to face an outside face in the rotation axis direction of the bearing at an interval, the fixing device further comprising:

a heat source; and a heated member heated by the heat source, wherein the rotating member is a pressuring roller configured to come into pressure contact with the heated member so as to form a fixing nip, the fixing device further comprising a supporting member configured to support the holding member so that the holding member is swingable between a first posture to make the pressuring roller come into pressure contact with the heated member and a second posture to make the pressuring roller separated from the heated member, wherein the holding member has a fitting part into which the bearing is fittable, removal of the bearing from the fitting part is restricted in a state where the holding member is in the first posture, the bearing is removable from the fitting part in a state where the holding member is in the second posture.

10. The fixing device according to claim 9, wherein the holding member has a flange part configured to protrude from an outer circumference of the fitting part toward an inside in the rotation axis direction.

* * * * *